US009234258B2

(12) United States Patent
Tunison

(10) Patent No.: US 9,234,258 B2
(45) Date of Patent: Jan. 12, 2016

(54) APPARATUS AND METHODS FOR PURIFYING LEAD

(71) Applicant: United States Department of Energy, Washington, DC (US)

(72) Inventor: Harmon M. Tunison, Scotia, NY (US)

(73) Assignee: U.S. Department of Energy, Washington, DC (US)

( * ) Notice: Subject to any disclaimer, the term of this patent is extended or adjusted under 35 U.S.C. 154(b) by 153 days.

(21) Appl. No.: 14/182,788

(22) Filed: Feb. 18, 2014

(65) Prior Publication Data

US 2014/0238198 A1 Aug. 28, 2014

Related U.S. Application Data

(60) Provisional application No. 61/768,832, filed on Feb. 25, 2013.

(51) Int. Cl.

| | |
|---|---|
| ***C22B 9/10*** | (2006.01) |
| ***C22B 13/02*** | (2006.01) |
| ***G21F 9/30*** | (2006.01) |
| ***C22B 13/06*** | (2006.01) |

(52) U.S. Cl.

CPC . *C22B 13/06* (2013.01); *C22B 9/10* (2013.01); *C22B 9/103* (2013.01); *C22B 9/106* (2013.01); *C22B 13/02* (2013.01); *C22B 13/025* (2013.01); *G21F 9/308* (2013.01)

(58) Field of Classification Search

CPC ..... G21F 9/308; C22B 13/02; C22B 13/025; C22B 9/10; C22B 9/103; C22B 9/106

See application file for complete search history.

(56) References Cited

U.S. PATENT DOCUMENTS

| | | | | |
|---|---|---|---|---|
| 4,552,588 | A * | 11/1985 | Elliott | C22B 60/0286 75/399 |
| 4,565,573 | A | 1/1986 | Symonds et al. | |
| H000137 | H * | 10/1986 | Briggs | C22B 60/02 75/398 |
| 4,911,755 | A | 3/1990 | Larouche | |
| 6,019,942 | A | 2/2000 | Gromov | |
| 7,147,823 | B2 | 12/2006 | Loewen | |
| 2003/0194345 | A1 | 10/2003 | Loewen | |
| 2006/0107794 | A1 | 5/2006 | Loewen et al. | |

FOREIGN PATENT DOCUMENTS

| | | | | |
|---|---|---|---|---|
| GB | 1010418 A * | 11/1965 | ..... | B22D 21/007 |

* cited by examiner

*Primary Examiner* — George Wyszomierski
*Assistant Examiner* — Tima M McGuthry Banks
(74) *Attorney, Agent, or Firm* — Robert T. Burns; John T. Lucas

(57) ABSTRACT

Disclosed is an exemplary method of purifying lead which includes the steps of placing lead and a fluoride salt blend in a container; forming a first fluid of molten lead at a first temperature; forming a second fluid of the molten fluoride salt blend at a second temperature higher than the first temperature; mixing the first fluid and the second fluid together; separating the two fluids; solidifying the molten fluoride salt blend at a temperature above a melting point of the lead; and removing the molten lead from the container. In certain exemplary methods the molten lead is removed from the container by decanting. In still other exemplary methods the molten salt blend is a Lewis base fluoride eutectic salt blend, and in yet other exemplary methods the molten salt blend contains sodium fluoride, lithium fluoride, and potassium fluoride.

19 Claims, 3 Drawing Sheets

APPARATUS AND METHODS FOR PURIFYING LEAD

NOTICE OF GOVERNMENT RIGHTS

The United States Government has rights in this application and any resultant patents claiming priority to this application pursuant to contract DE-AC12-00SN39357 between the United States Department of Energy and Bechtel Marine Propulsion Corporation Knolls Atomic Power Laboratory.

TECHNOLOGICAL FIELD

This present subject matter relates to lead purification.

BACKGROUND

Molten lead and/or its eutectics are leading candidates for the heat transfer medium and/or the spallation targets for next generation nuclear reactors and/or other systems using molten metal coolant. However, many of the eutectics are corrosive to many construction materials (iron based steels, for example) proposed to contain the molten material. The corrosive nature of these molten materials towards steel-based materials can be minimized by the careful control of oxygen in the molten material. Operating in the optimum range of dissolved oxygen allows a protective oxide layer to grow (and/or be maintained) on the steel-based materials, protecting the materials from corrosion by the molten material. For many oxygen control schemes, the lead first needs to be purified of its oxygen content before controlled application of oxygen back into the lead can occur. Due to the high cost of very pure lead, a lower grade of lead would be used for many large scale applications and purified in situ. Hydrogen gas can facilitate this purification process, but requires high pressure cylinders to be placed inline with and maintained in the system at all times. The time period involved for purification varies from hours to days, depending on the volume of lead to be purified. Once purified, the molten lead requires continued purification due to its interaction with the materials used to contain the molten metal, and possible contamination by oxygen egress into the system from the atmosphere. A need therefore exists for an improved apparatus and methods of purifying lead.

SUMMARY

Disclosed is an apparatus and methods for lead purification. In certain exemplary embodiments, a coolant purification device includes a container thermally connected with a heat source; an inlet configured to disperse molten lead into a first end of the container; a molten fluoride salt blend within the container interior; an outlet configured to discharge the molten lead from a second end of the container; and a tortuous path passing through the molten salt blend and connecting the inlet to the outlet. In certain exemplary embodiments the molten salt blend is a Lewis base fluoride eutectic salt blend, and in still other exemplary embodiments the molten salt blend contains sodium fluoride, lithium fluoride, and potassium fluoride.

Also disclosed is an exemplary method of purifying lead which includes the steps of thermally connecting a container with a heat source; filling at least a portion of the container with a molten fluoride salt blend; dispersing molten lead into a first end of the container; passing the molten lead along a tortuous path through the molten fluoride salt blend; and collecting the molten lead. In certain exemplary methods the lead is dispersed as lead droplets. In certain exemplary embodiments, the molten lead is collected from a second end of the container. In other exemplary embodiments the molten salt blend is a Lewis base fluoride eutectic salt blend, and in still other exemplary methods the molten salt blend contains sodium fluoride, lithium fluoride, and potassium fluoride.

Another exemplary method of purifying lead includes the steps of placing lead and a fluoride salt blend in a container; forming a first fluid of molten lead at a first temperature; forming a second fluid of molten fluoride salt blend at a second temperature higher than the first temperature; mixing the first fluid and the second fluid together; separating the two fluids; solidifying the molten fluoride salt blend at a temperature above a melting point of the lead; and removing the molten lead from the container. In certain exemplary methods the container is in an inert atmosphere. In other exemplary methods the molten lead is removed from the container by decanting. In still other exemplary methods the molten salt blend is a Lewis base fluoride eutectic salt blend, and in yet other exemplary methods the molten salt blend contains sodium fluoride, lithium fluoride, and potassium fluoride.

BRIEF DESCRIPTION OF THE DRAWINGS

A description of the present subject matter including various embodiments thereof is presented with reference to the accompanying drawings, the description not meaning to be considered limiting in any matter, wherein.

Similar reference numerals and designators in the various figures refer to like elements.

DETAILED DESCRIPTION

Figure 1:
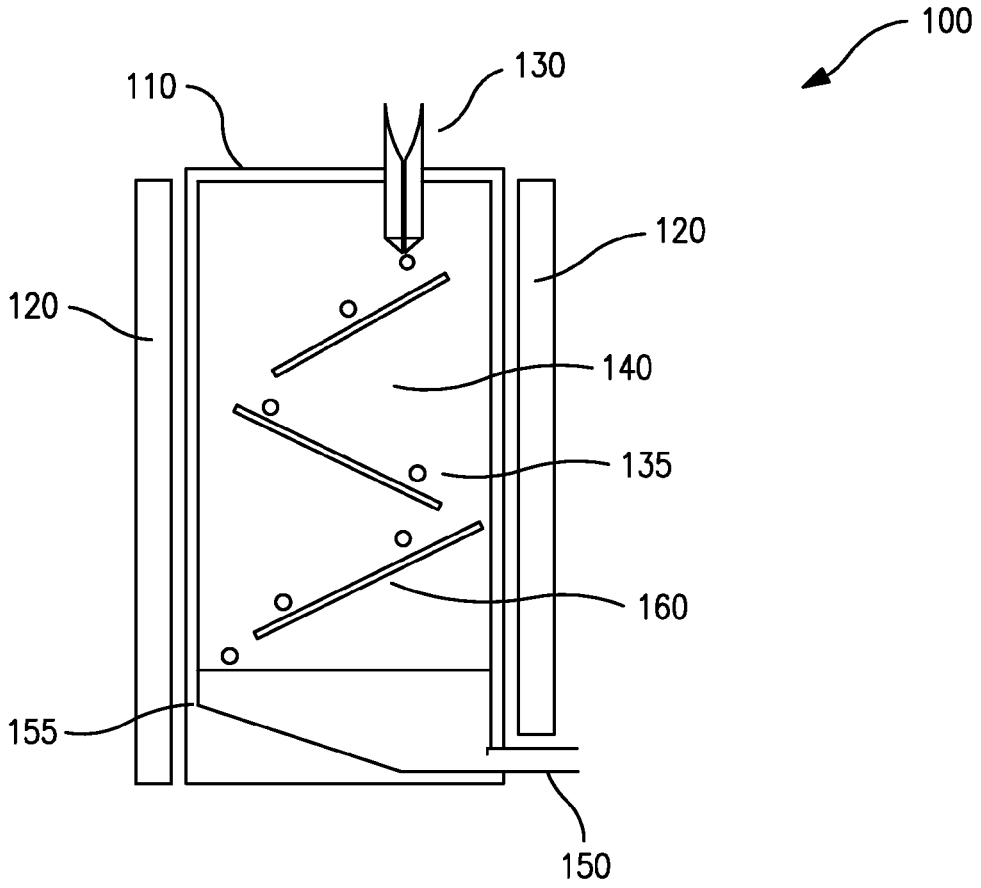
FIG. 1 illustrates an exemplary embodiment of a coolant purification device.

FIG. 1 illustrates an exemplary embodiment of a coolant purification device 100. In the exemplary embodiment shown, a container 110 is thermally connected with a heat source 120. In certain embodiments, the heat source is configured to heat the container to at least 1000° C., and the container is configured to withstand temperatures of at least 1000° C. In certain exemplary embodiments the container 110 is at least partially comprised of graphite. Other materials able to withstand contact with molten lead and/or molten salt can be used in place of or in addition to graphite without departing from the scope of the present subject matter. The container 110 has an inlet 130 configured to disperse molten lead 135 into a first end of the container. In certain exemplary embodiments the inlet 130 connects with a by-pass line (not shown), which connects to a coolant flow stream of molten lead 135. Although the molten lead 135 is shown as lead droplets, it need not be. In embodiments where the lead is dispersed as lead droplets, the inlet 130 is configured to disperse the molten lead as lead droplets. Other dispersal configurations can be used without departing from the scope of the present subject matter. In certain exemplary embodiments, a lead eutectic can be used, instead of or in addition to molten lead 135, without departing from the scope of the present subject matter.

The container 110 in this exemplary embodiment further includes a molten fluoride salt blend 140 within the container interior, and has an outlet 150 configured to discharge the molten lead from a second end of the container. In certain exemplary embodiments, container 110 further includes a collection area 155 configured to store and/or return purified metal to a coolant flow stream (not shown) and/or a coolant storage system (not shown). The exemplary embodiment shown further includes a tortuous path 160 passing through the molten salt blend 140 and connecting the inlet 130 to the outlet 150. In certain exemplary embodiments, the container 110 is configured such that the molten salt blend 140 flows in a countercurrent direction relative to the direction of the molten lead flow. In still other exemplary embodiments, outlet 150 connects with collection area 155 in an area below the molten salt interface with the molten lead 135 and is configured to direct the molten lead 135 into a coolant stream 170 (not shown).

In the exemplary embodiment of FIG. 1, the molten lead 135 passes through the molten salt blend 140 along tortuous path 160, which causes at least a portion of the molten lead 135 to roll and be deformed in some fashion. This allows at least a portion of the impurities in the lead to diffuse to the surface of the lead and be removed by interaction with the molten salt blend 140. Due to density differences and the immiscibility of the molten layers, impurity oxides dissolve into the molten salt blend 140 and are held as oxy-fluoride species and removed from the molten lead 135. The time for the molten lead 135 to travel through the molten salt blend 140 can be varied by including one or more obstacles (not shown) with tortuous path 160. In certain exemplary embodiments these obstacles cause the molten lead 135 to shift and rotate. Since oxides present in the molten lead 135 exist primarily on the surface of the lead, the molten lead has its surface purified as it travels through the molten salt 140.

The molten salt blend 140 has a melting point above the melting point of lead. The melting point of the molten fluoride salt blend is within a reasonable temperature range to that of the melting point of lead such that the system can be constructed without having to account for large thermal gradient effects. In certain exemplary embodiments, the melting point of the molten salt blend 140 has a melting point 150° C. higher than that of lead. This temperature is exemplary only. Other temperatures above the melting point of lead can be used without departing from the scope of the present subject matter. In still other exemplary embodiments, the molten salt blend 140 removes radioactive oxides from the molten lead 135. In certain exemplary embodiments, the molten fluoride salt blend 140 is a strong Lewis base fluoride salt blend which is utilized to dissolve the oxides present on the surface of molten lead. The purification process utilizes the oxide scavenging abilities of the molten salt blend 140 brought into contact with the molten lead 135. The density difference and immiscibility of the molten salt blend 140 with the molten lead 135 allows the surface layer of lead to be cleaned of oxides (which are then held in the molten salt layer as oxy-fluoride species) without contamination of the molten lead 135 by the molten salt blend 140. In certain exemplary embodiments, the molten salt blend 140 is a Lewis base fluoride eutectic salt blend. In other exemplary embodiments, the molten salt blend 140 contains sodium fluoride, lithium fluoride, and potassium fluoride. In still other exemplary embodiments, the molten salt blend 140 contains sodium fluoride, lithium fluoride, and potassium fluoride in a molar percentage blend of 47%, 11%, and 42% respectively. Other fluoride eutectics can be used in place of or in addition to the fluoride eutectics discussed above without departing from the scope of the present subject matter. Other exemplary molten salt blends include, but are not limited to, three component combinations of lithium fluoride (LiF), calcium fluoride ($CaF_2$), magnesium fluoride ($MgF_2$), potassium fluoride (KF), and sodium fluoride (NaF).

Figure 2:
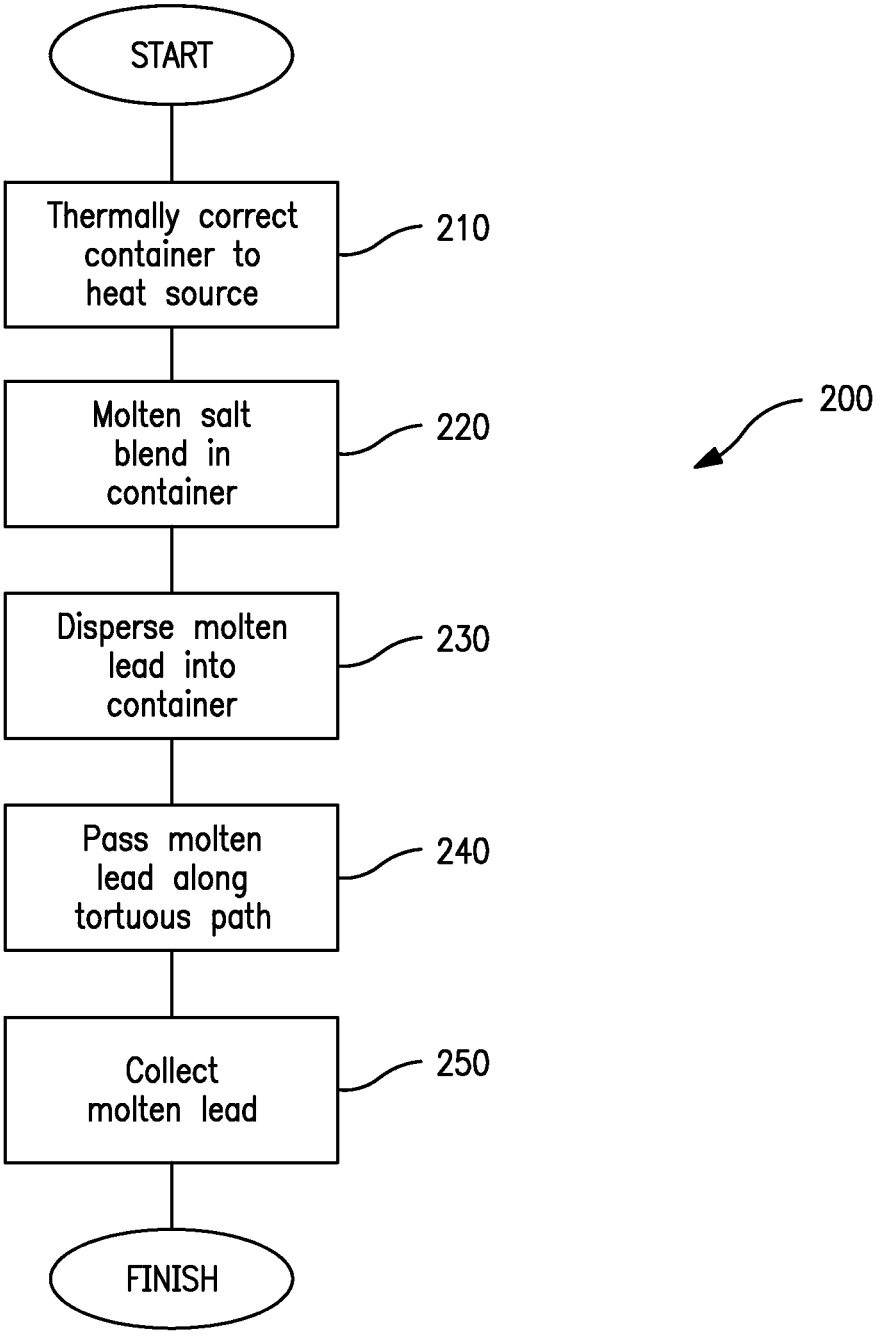
FIG. 2 illustrates an exemplary method of purifying lead.

FIG. 2 illustrates an exemplary method of purifying lead 200. The exemplary method of FIG. 2 includes the steps of thermally connecting a container with a heat source 210 and filling at least a portion of the container with a molten fluoride salt blend 220. The molten salt blend can be placed in the container by placing the salt blend in the container in solid form and heating it to melting, the molten salt blend can be formed elsewhere and then placed into the container, and/or the molten salt blend can be placed in the container using a combination of these methods. The exemplary method further includes the steps of dispersing molten lead into a first end of the container 230, passing the molten lead along a tortuous path through the molten fluoride salt blend 240, and collecting the molten lead 250. In certain exemplary methods the molten lead is dispersed into the first end of the container as lead droplets, and in still other exemplary methods the molten lead is collected from a second end of the container. In yet other exemplary embodiments, the molten salt blend is a Lewis base fluoride eutectic salt blend, and may contain sodium fluoride, lithium fluoride, and potassium fluoride. In still other exemplary methods, the sodium fluoride, lithium fluoride, and potassium fluoride are in a molar percentage blend of 47%, 11%, and 42% respectively. Certain exemplary methods further include the step of heating the molten fluoride salt blend to approximately 1000° C.

Figure 3:
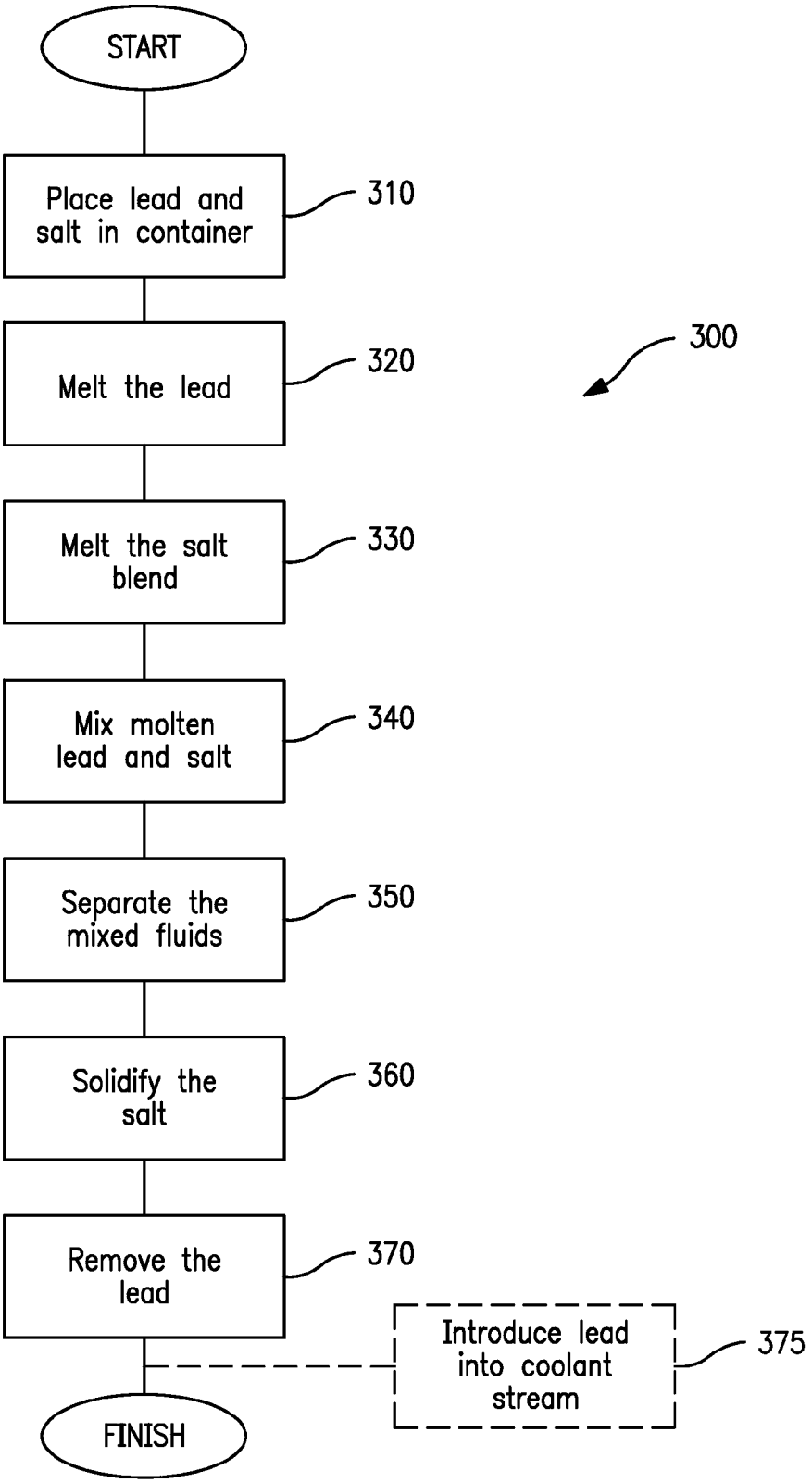
FIG. 3 illustrates another exemplary method of purifying lead.

FIG. 3 illustrates another exemplary method of purifying lead 300. The exemplary method 300 includes the steps of placing lead and a fluoride salt blend in a container 310 and forming a first fluid of molten lead 135 at a first temperature 320, forming a second fluid of molten fluoride salt blend 140 at a second temperature higher than the first temperature 330. In certain exemplary methods, the molten fluoride salt blend has a melting point 150° C. higher than that of lead. The exemplary method of FIG. 3 further includes the step of mixing the first fluid and the second fluid together 340. In certain exemplary methods, the first fluid and second fluid are mixed by agitation, though other mixing methods known to those of skill in the art may be used without departing from the scope of the present subject matter. Due to density differences and the immiscibility of the molten layers, the impurity oxides in the molten lead 135 dissolve into the molten salt 140 and are held there as oxy-fluoride species and removed from the lead. In certain exemplary embodiments, the molten salt blend 140 removes radioactive oxides from the molten lead 135. In certain exemplary methods, a lead eutectic can be used, instead of or in addition to molten lead 135, without departing from the scope of the present subject matter. The exemplary method of FIG. 3 further comprises the step of separating the mixed fluids 350, solidifying the molten fluoride salt blend at a temperature above a melting point of the lead 360. The solidified salt blend now contains the impurity oxides which had been in the molten lead 135. The exemplary method of FIG. 3 further includes the step of removing the molten lead from the container 370. In certain exemplary methods the molten lead 135 is collected from the bottom of the container, but need not be from that location. Other collection locations can be used without departing from the scope of the present subject matter. Certain exemplary methods further include the optional step of introducing the collected molten lead into a coolant stream 375.

In certain exemplary embodiments, after the salt is melted the two immiscible fluids are mixed and allowed to separate before the temperature is lowered to solidify just the salt mixture. The temperature is maintained above the melting point for lead and the purified molten lead 135 is decanted from beneath the solid salt. In certain embodiments the decanted molten lead is optionally introduced into a coolant system (not shown), into another container for cooling, or for other uses known to those of skill in the art. In certain exemplary embodiments, the container is in an inert atmosphere. In other exemplary embodiments, the molten lead is removed from the container by decanting. In still other exemplary embodiments, the molten salt blend is a Lewis base fluoride eutectic salt blend, which may contain sodium fluoride, lithium fluoride, and potassium fluoride. In yet other exemplary embodiments, the sodium fluoride, lithium fluoride, and potassium fluoride are in a molar percentage blend of 47%, 11%, and 42% respectively. In exemplary methods having a Lewis base fluoride eutectic salt blend, the purification process utilizes the ability of strong Lewis base molten fluoride salts to dissolve surface oxides from the molten lead, thus purifying the lead. These salt blends are exemplary only, however, as other blends can be used instead of and/or in addition to the blends above without departing from the scope of the present subject matter.

It will be understood that many additional changes in the details, materials, steps and arrangement of parts, which have been herein described and illustrated to explain the nature of the subject matter, may be made by those skilled in the art within the principle and scope of the invention as expressed in the appended claims.

The invention claimed is:

1. A coolant purification device, comprising:

a container thermally connected with a heat source;

an inlet configured to disperse molten lead into a first end of the container;

a molten fluoride salt blend within the container interior;

an outlet configured to discharge the molten lead from a second end of the container; and a tortuous path passing through the molten salt blend and connecting the inlet to the outlet, wherein the container is configured such that the molten salt blend flows in a countercurrent direction relative to a direction of the molten lead flow.

2. The coolant purification device of claim 1, wherein the inlet is configured to disperse the molten lead into the first end of the container as lead droplets.

3. The coolant purification device of claim 1, wherein the molten salt blend is a Lewis base fluoride eutectic salt blend.

4. The coolant purification device of claim 3, wherein the molten salt blend comprises at least three salts selected from the group consisting of lithium fluoride, calcium fluoride, magnesium fluoride, potassium fluoride, and sodium fluoride.

5. The coolant purification device of claim 3, wherein the molten salt blend contains sodium fluoride, lithium fluoride, and potassium fluoride.

6. The coolant purification device of claim 5, wherein the sodium fluoride, lithium fluoride, and potassium fluoride are in a molar percentage blend of 47%, 11%, and 42% respectively.

7. A method of purifying lead, comprising:

thermally connecting a container with a heat source;

filling at least a portion of the container with a molten fluoride salt blend;

dispersing molten lead into a first end of the container;

passing the molten lead along a tortuous path through the molten fluoride salt blend; and collecting the molten lead.

8. The method of claim 7, further comprising the step of dispersing the molten lead into the first end of the container as lead droplets.

9. The method of claim 7, further comprising the step of collecting the molten lead from a second end of the container.

10. The method of claim 7, wherein the molten salt blend is a Lewis base fluoride eutectic salt blend.

11. The method of claim 10, wherein the molten salt blend comprises at least three salts selected from the group consisting of lithium fluoride, calcium fluoride, magnesium fluoride, potassium fluoride, and sodium fluoride.

12. The method of claim 10, wherein the molten salt blend contains sodium fluoride, lithium fluoride, and potassium fluoride.

13. The method of claim 12, wherein the sodium fluoride, lithium fluoride, and potassium fluoride are in a molar percentage blend of 47%, 11%, and 42% respectively.

14. A method of purifying lead, comprising:

placing lead and a fluoride salt blend in a container;

forming a first fluid of molten lead at a first temperature;

forming a second fluid of molten fluoride salt blend at a second temperature higher than the first temperature;

mixing the first fluid and the second fluid together;

separating the mixed fluids;

solidifying the molten fluoride salt blend at a temperature above a melting point of the lead; and removing the molten lead from the container.

15. The method of claim 14, further comprising the step of placing the container in an inert atmosphere.

16. The method of claim 14, wherein the molten salt blend is a Lewis base fluoride eutectic salt blend.

17. The method of claim 16, wherein the molten salt blend comprises at least three salts selected from the group consisting of lithium fluoride, calcium fluoride, magnesium fluoride, potassium fluoride, and sodium fluoride.

18. The method of claim 17, wherein the molten salt blend contains sodium fluoride, lithium fluoride, and potassium fluoride.

19. The method of claim 18, wherein the sodium fluoride, lithium fluoride, and potassium fluoride are in a molar percentage blend of 47%, 11%, and 42% respectively.

* * * * *